US009129770B2

(12) United States Patent
Perkins et al.

(10) Patent No.: US 9,129,770 B2
(45) Date of Patent: Sep. 8, 2015

(54) ION SOURCE HAVING NEGATIVELY BIASED EXTRACTOR

(71) Applicant: Schlumberger Technology Corporation, Sugar Land, TX (US)

(72) Inventors: Luke Perkins, Plainsboro, NJ (US); Benjamin Levitt, Boston, MA (US); Peter Wraight, Skillman, NJ (US); Arthur D. Liberman, Palo Alto, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 196 days.

(21) Appl. No.: 13/830,401

(22) Filed: Mar. 14, 2013

(65) Prior Publication Data

US 2014/0263993 A1 Sep. 18, 2014

(51) Int. Cl.

| | |
|---|---|
| ***G21G 4/02*** | (2006.01) |
| ***H01J 27/02*** | (2006.01) |
| ***H01J 27/16*** | (2006.01) |
| ***H01J 27/20*** | (2006.01) |

(52) U.S. Cl.

CPC ..... *H01J 27/205* (2013.01); *G21G 4/02* (2013.01); *H01J 27/02* (2013.01); *H01J 27/16* (2013.01)

(58) Field of Classification Search

CPC ..... G21G 4/02; H01J 27/02; H01J 27/16; H01J 27/205

USPC ..... 250/253; 376/116, 108

See application file for complete search history.

(56) References Cited

U.S. PATENT DOCUMENTS

| | | | | |
|---|---|---|---|---|
| 5,279,669 | A * | 1/1994 | Lee | 118/723 MR |
| 5,293,410 | A | 3/1994 | Chen et al. | |
| 2003/0234355 | A1 * | 12/2003 | Leung et al. | 250/251 |
| 2004/0038505 | A1 * | 2/2004 | Ito et al. | 438/520 |
| 2009/0146052 | A1 | 6/2009 | Groves et al. | |
| 2010/0290575 | A1 | 11/2010 | Rosenthal | |
| 2011/0044418 | A1 | 2/2011 | Stubbers et al. | |
| 2012/0063558 | A1 * | 3/2012 | Reijonen et al. | 376/108 |
| 2012/0211166 | A1 * | 8/2012 | Yevtukhov et al. | 156/345.51 |
| 2013/0170592 | A1 * | 7/2013 | Zhou et al. | 376/114 |

FOREIGN PATENT DOCUMENTS

| | | | |
|---|---|---|---|
| WO | 2009099887 | A1 | 8/2009 |
| WO | WO 2009/099887 | A1 * | 8/2009 |

OTHER PUBLICATIONS

International Search Report and Written Opinion issued in PCT/US2014/018356 on Jun. 17, 2014, 15 pages.

* cited by examiner

*Primary Examiner* — David Porta
*Assistant Examiner* — Mindy Vu
(74) *Attorney, Agent, or Firm* — Michael Dae; Cathy Hewitt

(57) ABSTRACT

An ion source for use in a radiation generator includes a sealed envelope containing an ionizable gas therein. The ion source also includes a RF antenna external to the sealed envelope, the RF antenna to transmit time-varying electromagnetic fields within the sealed envelope for producing ions from the ionizable gas. There is at least one extractor within the sealed envelope having a potential such that the ions are attracted toward the at least one extractor.

16 Claims, 9 Drawing Sheets

ION SOURCE HAVING NEGATIVELY BIASED EXTRACTOR

FIELD OF THE DISCLOSURE

This disclosure is directed to the field of radiation generators, and, more particularly, to ion sources for radiation generators.

BACKGROUND

Well logging instruments that utilize radiation generators, such as sealed-tube neutron generators, have proven incredibly useful in oil formation evaluation. Such a neutron generator may include an ion source or ionizer and a target. An electric field, which is applied within the neutron tube, accelerates the ions generated by the ion source toward an appropriate target at a speed sufficient such that, when the ions are stopped by the target, fusion neutrons are generated and irradiate the formation into which the neutron generator is placed. The neutrons interact with elements in the formation, and those interactions can be detected and analyzed in order to determine characteristics of interest about the formation.

The generation of more neutrons for a given time period is desirable since it may allow an increase in the amount of information collected about the formation. Since the number of neutrons generated is related to, among other things, the number of ions accelerated into the target, ion generators that generate additional ions are desirable. In addition, power can be a concern, so increases in ionization efficiency can be useful; this is desirable because power is often limited in well logging applications.

As such, further advances in the area of ion sources for neutron generators are of interest. It is desired for such ion sources to generate a larger number of ions than present ion sources for a given power consumption.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An ion source for use in a radiation generator may include a sealed envelope containing an ionizable gas therein. There may be a RF antenna external to the sealed envelope, the RF antenna to transmit time-varying electromagnetic fields within the sealed envelope for producing ions from the ionizable gas. There may be at least one extractor within the sealed envelope having a potential such that the ions are attracted toward the at least one extractor.

Another aspect is directed to a well logging instrument which may include a sonde housing, and a radiation generator carried by the sonde housing. The radiation generator may include a sealed envelope containing an ionizable gas therein, with a RF antenna external to the sealed envelope, the RF antenna to transmit time-varying electromagnetic fields within the sealed envelope for producing ions from the ionizable gas. There may be at least one extractor within the sealed envelope having a potential such that the ions are attracted toward the at least one extractor. There may be a suppressor within the sealed envelope downstream of the at least one extractor, and a target within the sealed envelope downstream of the suppressor. The suppressor may have a potential such that the ions are accelerated toward the target.

A method aspect is directed to a method of generating ions in a radiation generator. The method may include transmitting time-varying electromagnetic fields within a sealed envelope for producing ions from ionizable gas within the sealed envelope, using a RF antenna external to the sealed envelope. The method may also include setting a potential of at least one extractor within the sealed envelope such that the ions are attracted toward the at least one extractor.

DETAILED DESCRIPTION

Figure 1:
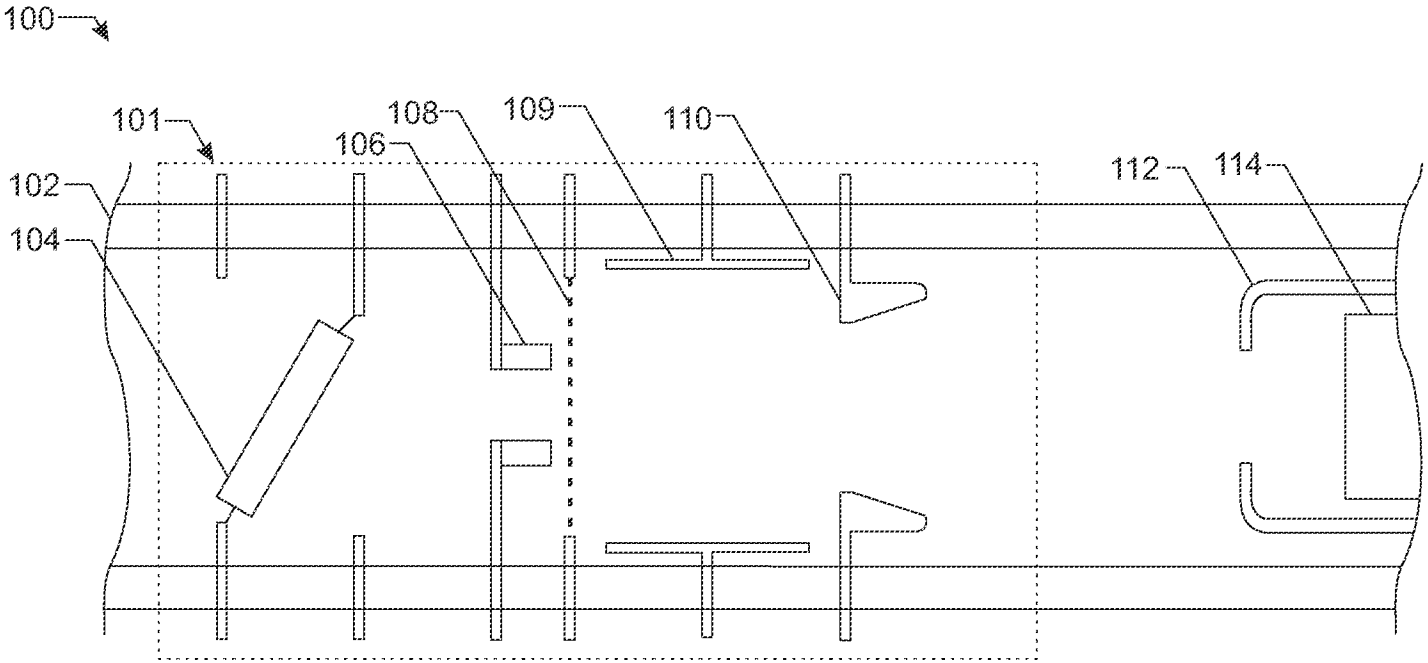
FIG. 1 is a schematic cross sectional view of a radiation generator in accordance with the present disclosure.
Figure 1A:
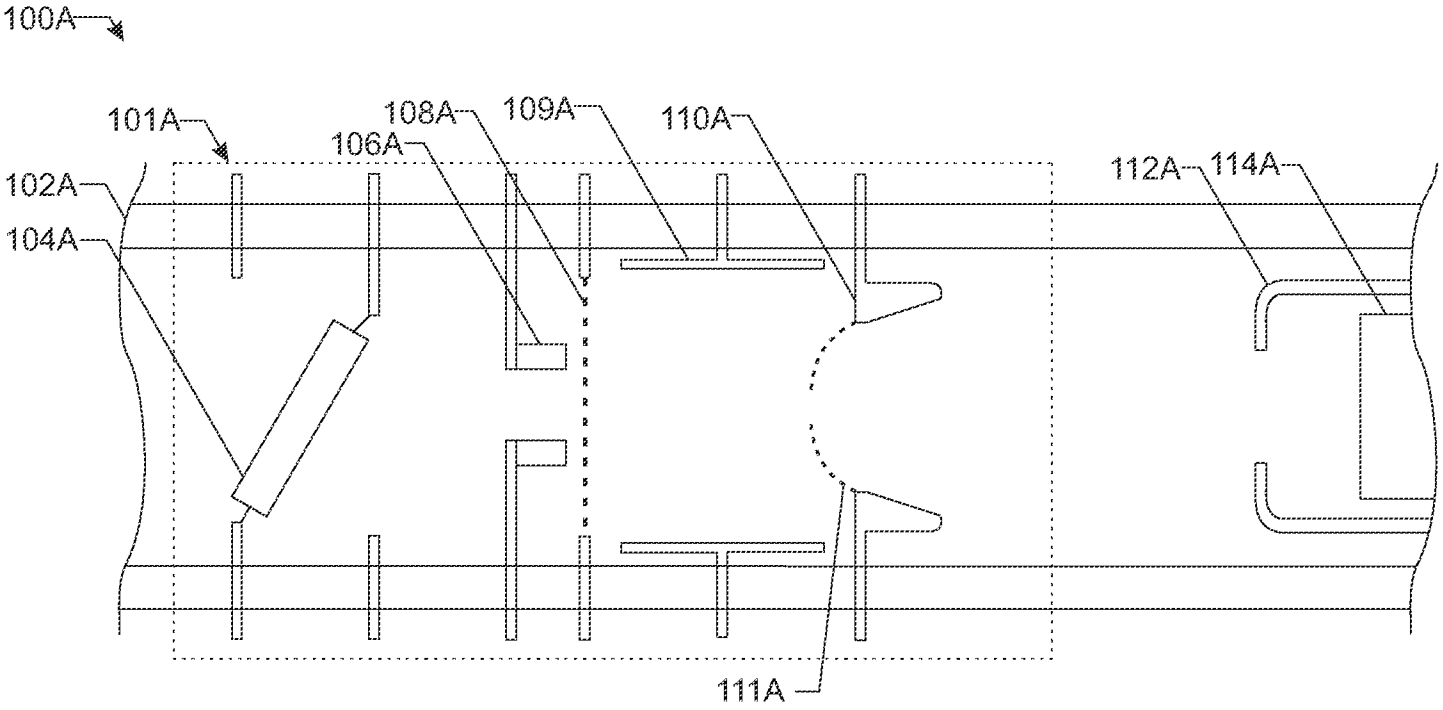
FIG. 1A is a schematic cross sectional view of a radiation generator in accordance with the present disclosure, wherein the extractor includes a grid extending across an opening therein.

One or more embodiments of the present disclosure will be described below. These described embodiments are only examples of the presently disclosed techniques. Additionally, in an effort to provide a concise description, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill in the art having the benefit of this disclosure. In the drawings, like numbers separated by century denote similar components in other configurations, although this does not apply to FIG. 7.

When introducing elements of various embodiments of the present disclosure, the articles "a," "an," and "the" are intended to mean that there are one or more of the elements.

The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

For clarity in descriptions, when the term "downstream" is used, a direction toward the target of a radiation generator tube is meant, and when the term "upstream" is used, a direction away from the target of a radiation generator tube is meant. "Interior" is used to denote a component carried within the sealed envelope of a radiation generator tube, while "exterior" is used to denote a component carried outside of the sealed envelope of a radiation generator tube. An "active" cathode is used to describe a cathode which is designed to emit electrons.

In addition, when any voltage or potential is referred to, it is to be understood that the voltage or potential is with respect to a reference voltage, which may or may not be ground. The reference voltage may be the voltage of the active cathode as described below, for example. Thus, when a "positive" voltage or potential is referred to, that means positive with respect to a reference voltage, and when a "negative" voltage of potential is referred to, that means negative with respect to a reference voltage.

With reference to FIG. 1, a radiation generator 100 is now described. The radiation generator includes an ion source 101. The ion source 101 includes a portion of a hermetically sealed envelope, with one or more insulator(s) 102 forming a part of the hermetically sealed envelope. The insulator 102 may be an insulator constructed from ceramic material, such as $Al_2O_3$. At least one ionizable gas, such as deuterium or tritium, is contained within the hermetically sealed envelope at a pressure of 1 mTorr to 20 mTorr, for example. A gas reservoir 104 stores and supplies this gas and can be used to adjust this gas pressure. It should be understood that the gas reservoir 104 may be located anywhere in the ion source 101 and need not be positioned as in the figures. In fact, the gas reservoir 104 may be positioned outside of the ion source 101, downstream of the extractor electrode 110.

The ion source 101 includes an active cathode, illustratively a hot cathode 106, downstream of the gas reservoir 104. As shown, the hot cathode 106 is a ring centered about the longitudinal axis of the ion source 101, as this may help to reduce exposure to backstreaming electrons. It should be understood that the ohmically heated cathode 106 may take other shapes, and may be positioned in different locations, however. In addition, it should be appreciated that the active cathode 106 may be a field emitter array (FEA) cathode or Spindt cathode, for example.

An cathode grid 108 is downstream of the hot cathode 106, and an extractor 110 is downstream of the cathode grid 108. In the case where the active cathode 106 is a FEA cathode or a Spindt cathode, the cathode grid 108 is optional. A optional cylindrical electrode 109 is downstream of the cathode grid 108. A suppressor 112 is downstream of the extractor 110, and a target 114 is downstream of the suppressor. The area between the cathode grid 108 and extractor 110 defines an ionization volume in which ionization of the ionizable gas occurs.

Operation of the radiation generator 101 is now described in general; a more detailed description will follow. In short, the hot cathode 106 emits electrons via thermionic emission which are accelerated toward the ionization volume by the voltage between the hot cathode and the cathode grid 108. The voltage difference may have an absolute value of up to 300V, for example with the cathode 106 being at +5V and the cathode grid being between +50V and +300V. The cylindrical electrode 109 defines the electrical field in the ion source 101, and is at a suitable potential to do so, for example the same potential as the cathode grid 108.

As the electrons travel, some of them interact with the ionizable gas to form ions. The ions are then pulled through the opening in the extractor 110, and accelerated toward the suppressor 112. The ions travel through the opening in the suppressor 112, and strike the target 114, ultimately resulting in the generation of neutrons. Since a pulsed neutron output is more useful for well logging applications, the voltage between the hot cathode 106 and cathode grid 108 is pulsed. This ultimately results in the generation of bursts of neutrons in discrete pulses.

The extractor 110 is biased to a negative potential such that the positive ions are attracted toward and through the extractor. The value of the negative potential used is based upon the geometry of the ion source and the ion density thereof. If the ion source aspect ratio (the ratio of the diameter of the aperture in the extractor 110 to the length of the ionization region) is low, a large negative potential is helpful. Conversely, if the ion source aspect ratio is large, a lesser negative potential may be suitable. With an ion source aspect ratio of about 1:1, the negative potential may be from between −100V to −1500V, for example.

The extractor 110 may be continuously biased to have the negative potential, or the potential may be applied in a pulse. Although continuously biasing the extractor 110 is electrically simpler, doing so may not sufficiently prevent the leakage of ions into the rest of the radiation generator 100 as much as desired between pulses of the cathode grid 108. This could degrade the neutron burst timing, which may be undesirable for well logging applications.

Thus, the extractor 110 may be pulsed in time with the cathode grid 108, helping to reduce or prevent ion leakage between pulses of the cathode grid 108. In some applications, the extractor 110 may have the negative potential during a pulse of the cathode grid 108 (e.g. when the cathode grid is at a positive potential) but be at the reference potential (for example, the potential of the cathode 106 as describe above) between positive pulses of the cathode grid (e.g. when the cathode grid is not at a positive potential). Likewise, the extractor 110 may have the negative potential during a pulse of the cathode grid 108, but be at a positive potential between pulses of the cathode grid. Although such configurations may be more complex technically, they may help to reduce the leakage of ions out of the ion source 101 between pulses of the cathode grid 108 (and thus between desired neutron bursts).

The negative potential of successive pulses of the extractor 110 may be different. For example, each successive pulse may have a larger negative potential, or a given number of pulses in a row may have a first negative potential, and then a given number of pulses in a row may have a second negative potential. This applies equally to the positive potential of the pulses if the extractor 110 is pulsed between the negative potential and a positive potential. In addition, the negative potential may change during a pulse. If the extractor 110 is pulsed between the negative potential and a positive potential, the positive potential may change during a post as well.

Rather than modifying the pulses of the extractor 110, or in addition to modifying the pulses of the extractor, the pulses of the cathode grid 108 may be modified. For example, the positive value of successive pulses of the cathode grid may be unequal, and positive value of a given pulse may change during that pulse. This may help in further temporally fine tuning the neutron output of the radiation generator 100.

In some applications, it may be advantageous to not pulse the extractor 110 with the negative potential simultaneously with the cathode grid 108, and to instead pulse the extractor after the cathode grid is pulsed. This may be useful if it is found that the potential of the extractor 110 is repelling the electrons and thus reducing the volume of the ionization region, for example, so as to allow ion formation in the ionization region in the absence of the extractor potential. This may also be useful in fine tuning the neutron output of the radiation generator 100.

If ions are not pulled out of the ionization region quickly after generation, they may recombine with electrons or the walls and once again become neutral atoms unsuitable for generating neutrons. This ion source 101 is particularly advantageous in that the negative voltage of the extractor 110 helps to quickly pull the ions out of the ionization region and into the rest of the radiation generator 100. This has been found to greatly increase the number of ions accelerated toward the target 114, and thus greatly increase the number of neutrons generated. In addition, the negative biasing of the extractor 110 has been found to help focus the ions into an ion beam better than conventional ion sources, thus further helping to improve neutron output. This ion source 100 has been found to increase neutron input by up to, or even beyond, 40%.

It may be advantageous to help repel the ions away from the cathode 106 in addition to attracting them toward the extractor 110 in some situations. To help effectuate this, the cathode 106 may have a positive potential (either continuous, or pulsed), and the cathode grid 108 may have a positive potential greater than that of the cathode. These positive potentials are such that the ions are repelled away from the cathode 106 and toward the extractor 110. This may help increase the number of ions that exit the ion source 101.

Figure 2:
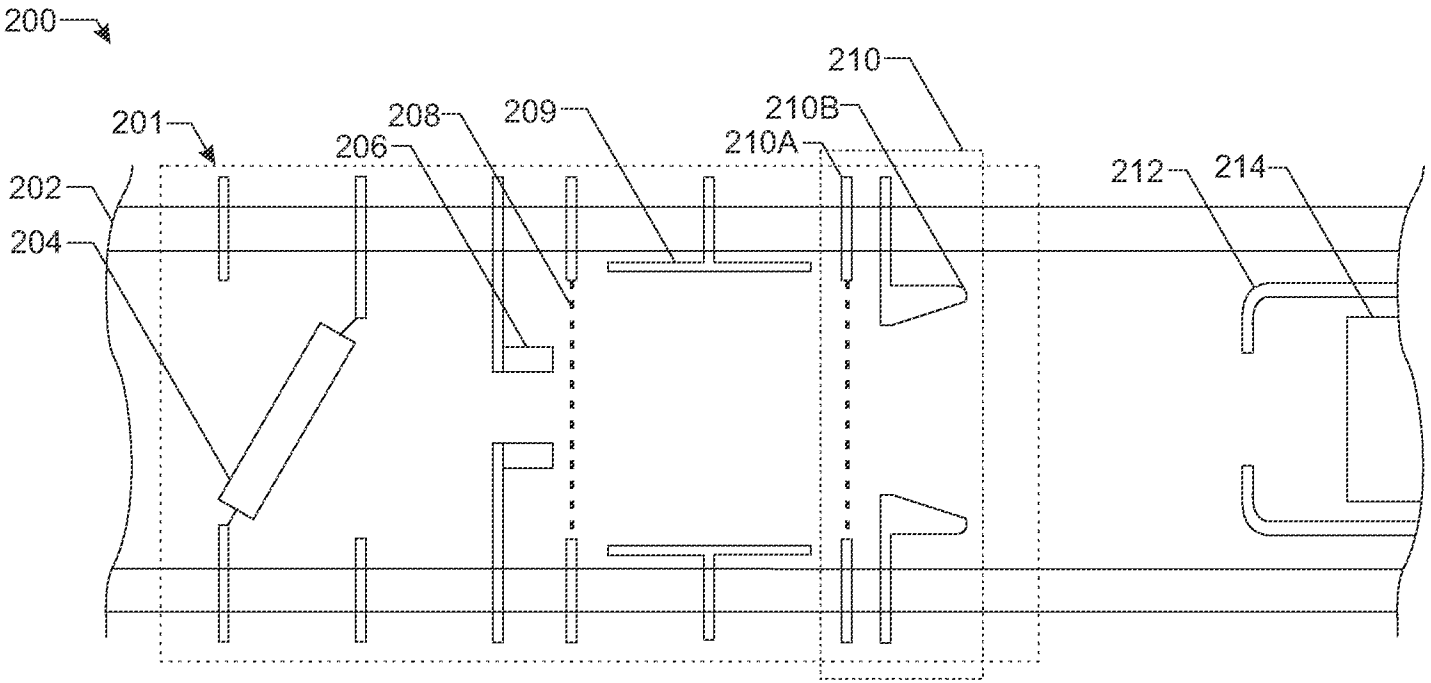
FIG. 2 is a schematic cross sectional view of an alternative configuration of a radiation generator in accordance with the present disclosure, wherein there is an extractor grid.
Figure 3:
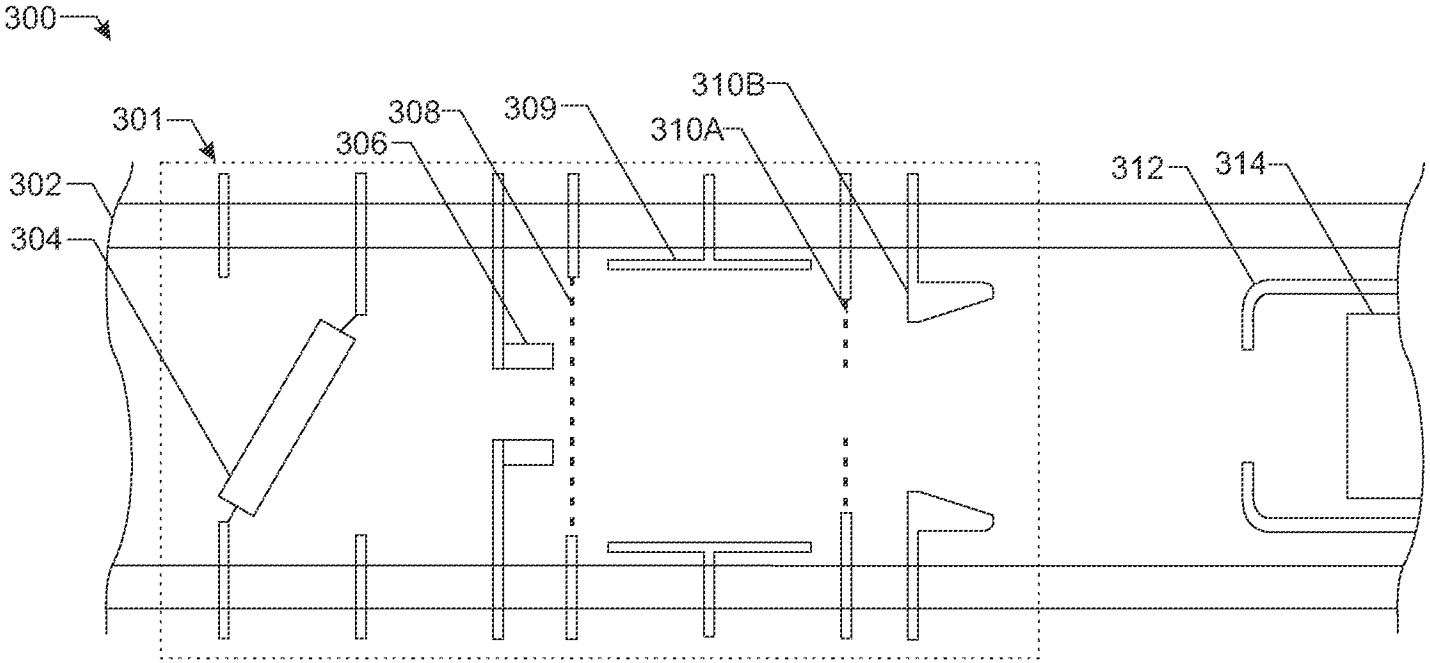
FIG. 3 is a schematic cross sectional view of an alternative configuration of a radiation generator in accordance with the present disclosure, wherein there is an extractor grid having a gap defined therein.
Figure 4:
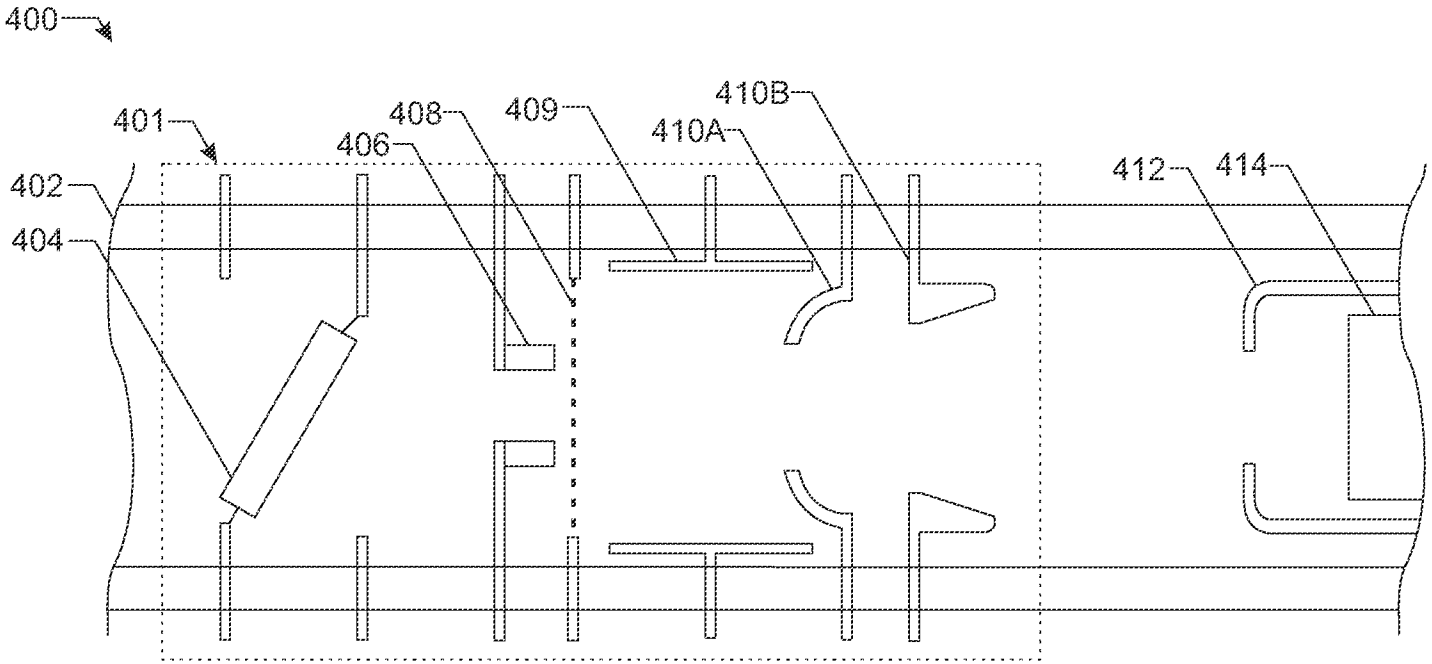
FIG. 4 is a schematic cross sectional view of an alternative configuration of a radiation generator in accordance with the present disclosure, wherein there are multiple extractor electrodes.
Figure 5:
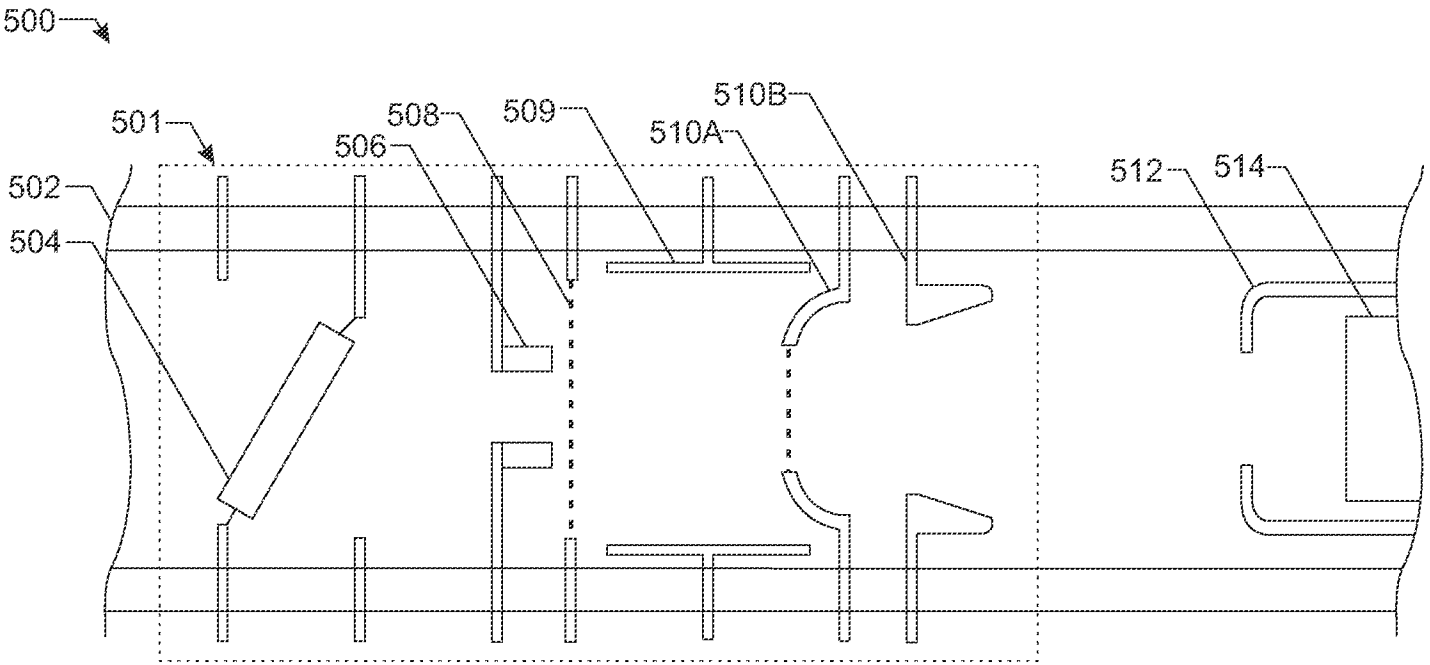
FIG. 5 is a schematic cross sectional view of an alternative configuration of a radiation generator in accordance with the present disclosure, wherein there are multiple extractor electrodes, one of which has an extractor grid extending across an aperture defined therein.
Figure 6:
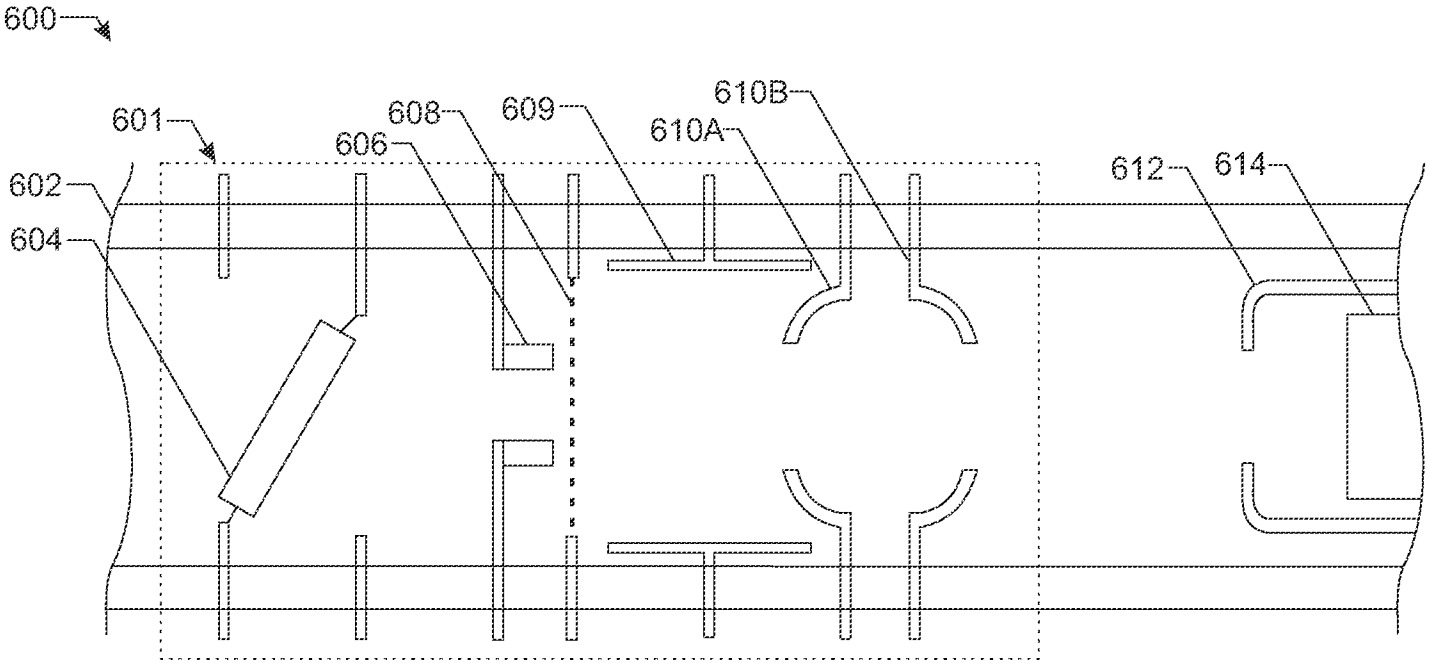
FIG. 6 is a schematic cross sectional view of an alternative configuration of a radiation generator in accordance with the present disclosure, wherein there are multiple extractor electrodes.

Those of skill in the art will understand that the principles of this disclosure are applicable to any ion source, and that various ion sources may have different extractor configurations to further increase ion extraction and improve beam focusing. For example, as shown in FIG. 2, there may be an extractor grid 210A downstream of the cylindrical electrode 209, and an extractor electrode 210B downstream of extractor grid 210. While both extractors 210 have negative potentials at least part of the time in accordance with the principles of this disclosure, here the extractor electrode 210B has a potential less negative than the potential of the extractor grid 210A. (A similar configuration is shown in FIG. 3, but here the extractor grid 310A has an aperture in it. The benefits of having both an extractor grid and an extractor electrode are in fine tuning the extraction of ions from the ion source, and in fine tuning the repelling of ions away from the extractor when desired. Indeed, the overall potential differences between the cathode grid and extractors may be less than in other configurations due to the finer shaping of the electric field as may be accomplished with having both an extractor grid and an extractor electrode. In addition, the focusing of the ions exiting the ion source may be more gradual due to the finer shaping of the electric field. Moreover, the portions of the ionization volume in which the majority of ionization takes place may be tuned. Rather than an extractor grid and an extractor electrode, there may instead be two extractor electrodes 410A, 410B having different shapes, as shown in FIG. 4. As shown in FIG. 5, the configuration from FIG. 4 may include an extractor grid across the aperture in the extractor electrode 410A. In some cases, there may be two extractor electrode 610A, 610B having similar shapes but oriented differently. Also, in an application with a single extractor 110A, there may be an extractor grid 111A extending from the opening in the extractor, and the extractor grid itself may have an opening therein.

Figure 7:
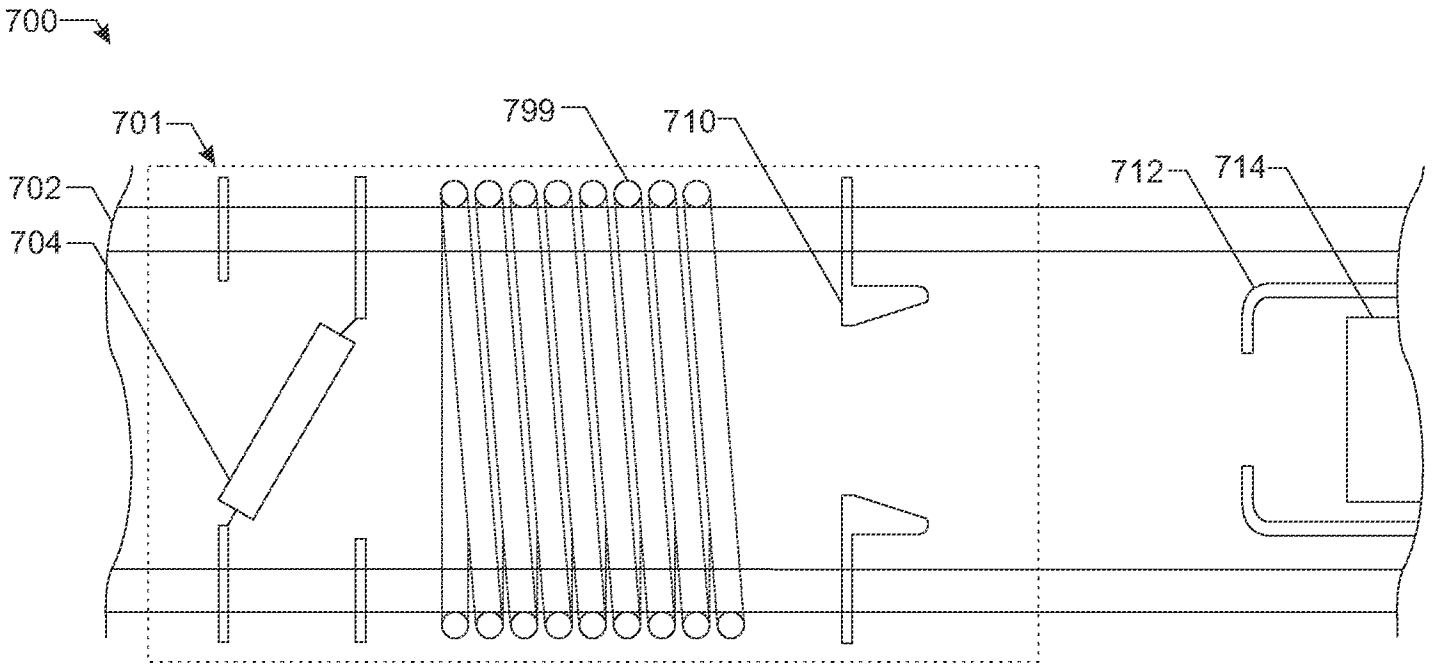
FIG. 7 is a schematic cross sectional view of a radiation generator that uses RF signals to create ions, in accordance with the present disclosure.

Those of skill in the art will appreciate that the above techniques are not limited to radiation generators that utilize the acceleration of electrons to create ions. Such an application is shown in FIG. 7, where the radiation generator 700 includes a coil 799 wrapped around the outside of the sealed envelope 702. The coil 799 is driven at in a suitable fashion with suitable frequencies so as to cause ion generation in the ionization volume, as will be understood by those of skill in the art. It should be appreciated that the coil 799 may also be internal to the sealed envelope 702 in some cases, and that any suitable configuration may be used.

Figure 8:
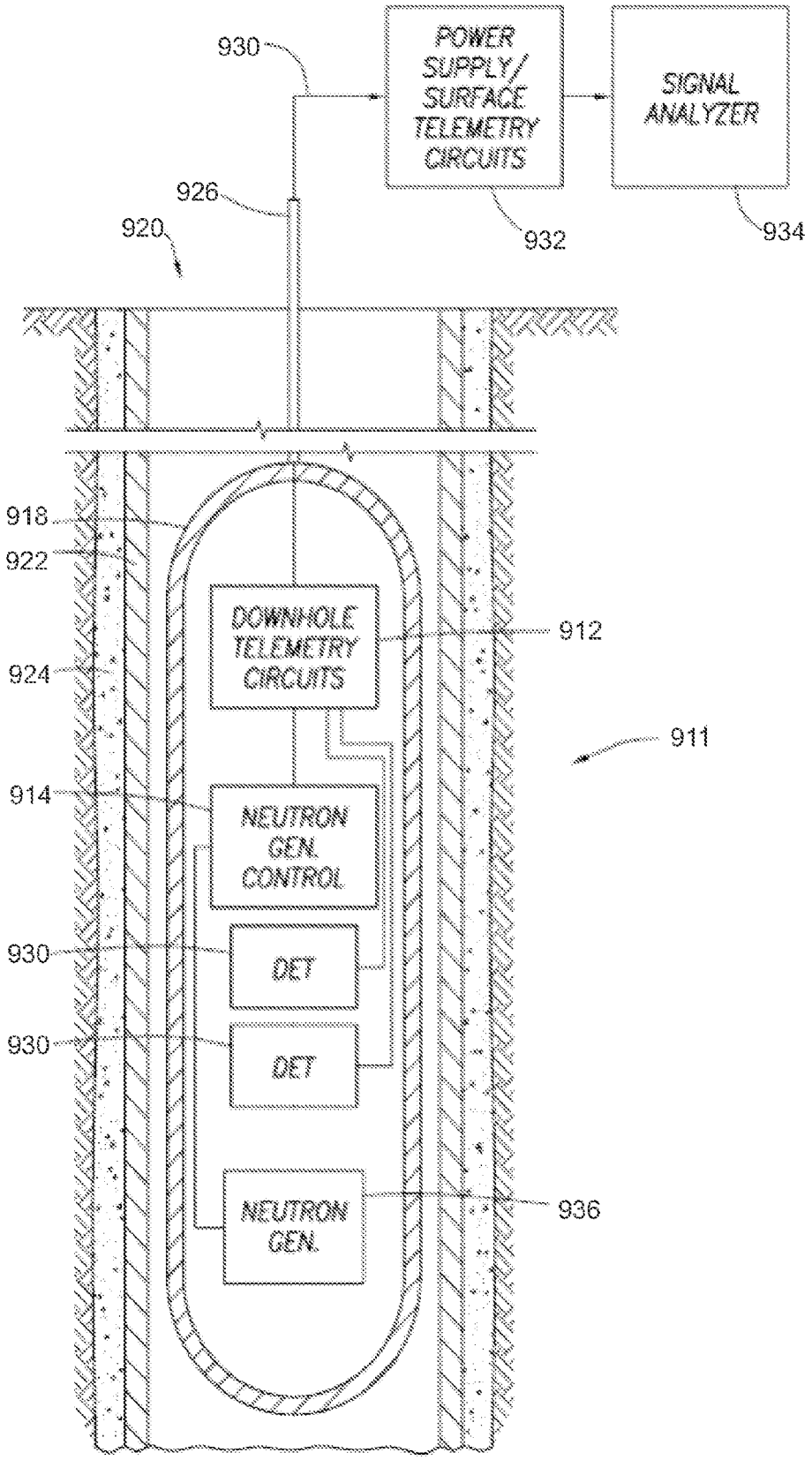
FIG. 8 is a schematic block diagram of a well logging instrument in which the radiation generator disclosed herein may be used.

Turning now to FIG. 8, an example embodiment of a well logging instrument 911 is now described. A pair of radiation detectors 930 are positioned within a sonde housing 918 along with a radiation generator 936 (e.g., as described above as radiation generator 100, 200, 300, 400, 500, 600, and 700 in FIGS. 1-7) and associated high voltage electrical components (e.g., power supply). The radiation generator 936 employs an ion source in accordance with the present invention and as described above. Supporting control circuitry 914 for the radiation generator 936 (e.g., low voltage control components) and other components, such as downhole telemetry circuitry 912, may also be carried in the sonde housing 918.

The sonde housing 918 is to be moved through a borehole 920. In the illustrated example, the borehole 920 is lined with a steel casing 922 and a surrounding cement annulus 924, although the sonde housing 918 and radiation generator 936 may be used with other borehole configurations (e.g., open holes). By way of example, the sonde housing 918 may be suspended in the borehole 920 by a cable 926, although a coiled tubing, etc., may also be used. Furthermore, other modes of conveyance of the sonde housing 918 within the borehole 920 may be used, such as wireline, slickline, and logging while drilling (LWD), for example. The sonde housing 918 may also be deployed for extended or permanent monitoring in some applications.

A multi-conductor power supply cable 930 may be carried by the cable 926 to provide electrical power from the surface (from power supply circuitry 932) downhole to the sonde housing 918 and the electrical components therein (i.e., the downhole telemetry circuitry 912, low-voltage radiation generator support circuitry 914, and one or more of the above-described radiation detectors 930). However, in other configurations power may be supplied by batteries and/or a downhole power generator, for example.

The radiation generator 936 is operated to emit neutrons to irradiate the geological formation adjacent the sonde housing 918. Gamma-rays that return from the formation are detected by the radiation detectors 930. The outputs of the radiation detectors 930 are communicated to the surface via the downhole telemetry circuitry 912 and the surface telemetry circuitry 932 and may be analyzed by a signal analyzer 934 to obtain information regarding the geological formation. By way of example, the signal analyzer 934 may be implemented by a computer system executing signal analysis software for obtaining information regarding the formation. More particularly, oil, gas, water and other elements of the geological formation have distinctive radiation signatures that permit identification of these elements. Signal analysis can also be carried out downhole within the sonde housing 918 in some embodiments.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. An ion source for use in a radiation generator comprising:

a sealed envelope configured to contain an ionizable gas;

a radio frequency (RF) antenna associated with the sealed envelope, wherein the RF antenna is configured to generate time-varying electromagnetic fields within the sealed envelope to produce ions from the ionizable gas; and at least one extractor within the sealed envelope, wherein the at least one extractor is configured to be pulsed to a negative potential with respect to ground during operation such that the ions are attracted toward the at least one extractor.

2. The ion source of claim 1, wherein the negative potential of successive pulses is not equal.

3. The ion source of claim 1, wherein the negative potential changes during a given pulse.

4. The ion source of claim 1, wherein the at least one extractor comprises a plurality of extractors.

5. The ion source of claim 4, wherein at least one of the plurality of extractors comprises an electrode or an extractor grid.

6. The ion source of claim 1, wherein the at least one extractor comprises an extractor grid.

7. A well logging instrument comprising:

a sonde housing; and a radiation generator carried by the sonde housing, wherein the radiation generator comprises:

a sealed envelope configured to contain an ionizable gas, a radio frequency (RF) antenna associated with the sealed envelope, wherein the RF antenna is configured to generate time-varying electromagnetic fields within the sealed envelope to produce ions from the ionizable gas, at least one extractor within the sealed envelope, wherein the at least one extractor is configured to be pulsed to a negative potential with respect to ground during operation such that the ions are attracted toward the at least one extractor, a suppressor within the sealed envelope downstream of the at least one extractor, and a target within the sealed envelope downstream of the suppressor, wherein the suppressor is configured to have a potential such that the ions are accelerated toward the target.

8. The well logging instrument of claim 7, wherein the negative potential of successive pulses is not equal.

9. The well-logging tool of claim 7, wherein the negative potential changes during a given pulse.

10. The well-logging tool of claim 7, wherein the at least one extractor comprises a plurality of extractors.

11. The well-logging tool of claim 7, wherein the at least on extractor comprises an electrode or an extractor grid.

12. A method of generating ions in a radiation generator comprising:

generating time-varying electromagnetic fields within a sealed envelope used to produce ions from ionizable gas carried within the sealed envelope, using a radio frequency (RF) antenna associated with the sealed envelope; and pulsing at least one extractor within the sealed envelope to a negative potential with respect to ground during operation such that the ions are attracted toward the at least one extractor.

13. The method of claim 12, wherein the negative potential of successive pulses are set to be unequal.

14. The method of claim 12, wherein the negative potential changes during a given pulse.

15. The method of claim 12, wherein the at least one extractor comprises a plurality of extractors.

16. The method of claim 12, wherein the at least on extractor comprises an electrode or an extractor grid.

* * * * *